United States Patent [19]

Berghefer

[11] Patent Number: 5,014,452

[45] Date of Patent: May 14, 1991

[54] PLOW MOUNTING APPARATUS

[76] Inventor: Ray A. Berghefer, 435 Hecla St., Laurium, Mich. 49913

[21] Appl. No.: 313,027

[22] Filed: Feb. 21, 1989

[51] Int. Cl.[5] ..... E01H 5/04

[52] U.S. Cl. ..... 37/235; 37/231; 172/272; 172/817

[58] Field of Search ..... 37/98, 103, 197, 183 A, 37/231, 235; 172/272, 274, 275, 817; 414/723

[56] References Cited

U.S. PATENT DOCUMENTS

| | | | |
|---|---|---|---|
| 1,724,494 | 8/1929 | Maust | 37/231 X |
| 3,312,478 | 4/1967 | Knaapi | 172/272 |
| 3,672,521 | 6/1972 | Bauer et al. | 414/723 |
| 3,851,894 | 12/1974 | St. Pierre | 172/275 X |
| 4,030,624 | 6/1977 | Matthews | 172/272 X |
| 4,586,867 | 5/1986 | Stafford | 414/723 |

*Primary Examiner*—Randolph A. Reese
*Assistant Examiner*—Franco S. DeLiguori
*Attorney, Agent, or Firm*—Thomas D. Wilhelm

[57] ABSTRACT

Plow attaching apparatus for attaching a plow having a blade and a frame to a vehicle in a quick and efficient manner. The attachment apparatus includes a pair of attaching pins which are extended into mounting holes attached to the vehicle, and correspondingly retracted therefrom, by a pair of operating arms which are capable of pivoting with respect to mounting means. The apparatus may include adapter brackets mounted to the vehicle and a jack mounted on the plow. Novel methods of attaching and detaching the plow to the vehicle are also disclosed.

13 Claims, 4 Drawing Sheets

PLOW MOUNTING APPARATUS

BACKGROUND OF THE INVENTION

This invention relates to a plow for mounting on a vehicle, and especially to snow plows which are mounted on pick up trucks.

Typically, in order to mount a conventional plow to the truck, the user has to get under the truck and install mounting bolts which pass through mounting holes on the truck and corresponding mounting holes on the plow frame. Typically, two such bolts are used in mounting the plow to the truck between the front suspension and the front bumper. A lift chain, attached to a portion of the plow frame, forward of the truck front bumper, is then attached to a lift arm which extends from the front of the truck. As the lift arm is lifted, the plow is accordingly lifted and pivots about the two mounting bolts which mount the plow to the truck frame.

Conventional dismounting of the plow from the truck follows a similar procedure of removing the lift chain and rolling under the truck to loosen and pull the mounting pins.

In some cases a block, such as a piece of wood or the like, is placed under the plow frame to receive the weight of the plow frame and thus assist in loosening the pins for disengagement. The plow can be left on that same block, preferably positioning the plow mounting holes at the proper height for remounting to the truck.

While the above procedure is effective to attach and remove the plow, it requires the user to get under the vehicle in order to do so.

The most common use anticipated for plows of this invention is in moving snow. In the snow environment, there is usually snow on the ground, and there may be mud, water, and/or ice. Getting under the truck to mount and dismount the plow under these conditions is not desirable. Further, there may be dripping of cold water from the vehicle above which would drip on the person under the vehicle while mounting or dismounting the plow.

It is an object of this invention to provide plow attaching apparatus which circumvents the need for getting under the truck for routine mounting and dismounting of the conventional plow.

It is another object of the invention to provide a means for quickly attaching a plow to the vehicle, or correspondingly quickly detaching it.

It is a further object to provide a modified plow which includes attaching apparatus for quickly attaching the plow to a vehicle.

It is yet a further object to provide a vehicle with a plow which can be quickly attached to the vehicle or detached from it.

Another object of the invention is to provide a method of attaching a plow to a vehicle, especially without having to get under the vehicle when the plow is attached or removed.

Finally, it is an object of the invention to provide a method of quickly attaching a plow to a vehicle, or quickly detaching it.

SUMMARY OF THE INVENTION

Certain of the objects of the invention are achieved in plow attaching apparatus, comprising first and second operating arms, mounted to a base by corresponing mounting means, the operating arms being capable of pivoting about the corresponding mounting means. A first pin is engaged with an end of the first operating arms remote from the first corresponding mounting means. A second pin is engaged with an end of the second operating arm remote from the second correspondinng mounting means. The plow attaching apparatus further comprises means for sequentially moving the remote ends of the operating arms (i) away from each other and (ii) toward each other. The pins can thus be inserted into, and withdrawn from, mounting holes in apparatus cooperatively positioned proximate the pins.

Since the plow can be quite heavy for an individual to move, and since the alignment of the plow and the vehicle is usually not exact when the attachment is attempted, it is preferred that each of the pins comprise an alignment end portion having a lesser cross-section, an engagement portion having a greater cross-section, and a beveled intermediate transition portion between the alignment and engagement portions. The engagement portion is between the transition portion and the locus of the engagement between the pin and the first end of the corresponding one of the operating arms.

Preferred embodiments of the plow attaching apparatus of the invention include a jack mounted to the plow frame and capable of raising and lowering the plow frame for vertical alignment of the pins, and thus the engagement holes in the plow frame, with the holes in the vehicle.

In preferred embodiments of the invention the operating arms can be described as having first and second ends. The first ends are the ends in engagement with the pins. The mounting means, and thus the locus about which the arms pivot, is between the first and second ends. These embodiments comprises means for moving the second ends of the operating arms, which causes the operating arms to pivot about the mounting means with corresponding movement of the first ends, and accordingly of the pins as recited above.

The plow attaching apparatus comprising the operating arms, the pins, and the means for moving the operating arms and correspondingly the pins, may be attached to a base plate which is in itself attached to the plow frame. Alternatively, the plow frame may be modified for attachment of the several parts, and especially the operating arms and the pins, directly to the plow frame.

The first and second pins are preferably slideably received in corresponding first and second pin holding means such as barrels which are attached either to the plow frame, such as the structural members which transmit the force from the vehicle to the blade, or to the above recited base plate.

Preferably, the attaching apparatus includes first and second adapter brackets mountable on conventional plow mounting brackets of a vehicle. The brackets are adapted for reciving the pins as the attachment mechanism to the vehicle. The adapter brackets have side plates with holes which are to be aligned with the mounting holes in the plow frame. The side plates on the adapter brackets include flare guides angled for guiding the plow frame into the brackets. The brackets further comprise stop means adapted to stop the relative advance of the plow frame into the brackets when the mounting holes in the attachment ears of the plow frame are aligned with the holes in the side plates of the adapter brackets. The pins thus extend through the holes in the adapter bracket side plates and the holes in the plow attachment ears, whereby the plow is attached to the adapter bracket which are attached to the vehicle.

Desirably, the pins are loosely attached to the balance of the attachment apparatus whereby the force transmitted from the vehicle to the blade passes from th vehicle structural member through the pins to the plow frame without passing through the balance of the attachment apparatus. The invention further comprises the method of attaching a plow to a vehicle, the method comprising the steps of bringing mounting holes on the vehicle into at least partial alignment with a pair of corresponding mounting holes on the plow, and pivoting first and second operating arms, mounted on the plow by corresponding first and second mounting means, about the corresponding mounting means and away from each other and thereby inserting attaching pins engaged with the operating arms into the mounting holes on the vehicle and the plow. The method can include the step of operating a jack mounted on the plow and engaging the plow and thereby positioning the height of the mounting holes on the plow to correspond with the height of the mounting holes on the vehicle.

In preferred embodiments of the method, the combination of the first and second operating arms and the attaching pins is jointly pivoted against a combined operating stop, and then is retracted away from the combined operating stop while leaving the attaching pins engaged in the mounting holes on the vehicle and the plow.

Another description of the method of the invention includes the step of mounting, on the plow, the plow attaching apparatus comprising the operating arms mounted to a base, the pins, and the moving means for sequentially moving the remote ends of the operating away from each other and toward each other. This embodiment includes positioning the height of the mounting holes on the plow to correspond with the height of corresponding mounting holes on the vehicle, preferably by opertion of a jack which is attached either directly or indirectly to the plow frame, and engaging the ground. The mounting holes on the vehicle are then brought into at least partial alignment with the mounting holes on the plow. The first and second operating arms are then pivoted about the mounting means, thereby inserting pins engaged with the operating arms into the mounting holes on the vehicle and the mounting holes on the plow. Preferably, when the attaching means is mounted on the plow frame, the pins are fully aligned with the mounting holes on the plow prior to inserting the pins into the mounting holes on the vehicle. Preferably, the pins are mounted in barrels and both the barrels and the operating arms are securely, and loosely, mounted to the plow frame. As a result, force is transmitted from the vehicle to the plow blade through the pins and through the plow frame, but not through the barrels and the operating arms.

BRIEF DESCIPTION OF THE DRAWINGS

DETAILED DESCRIPTION OF THE ILLUSTRATED EMBODIMENT

Figure 1:
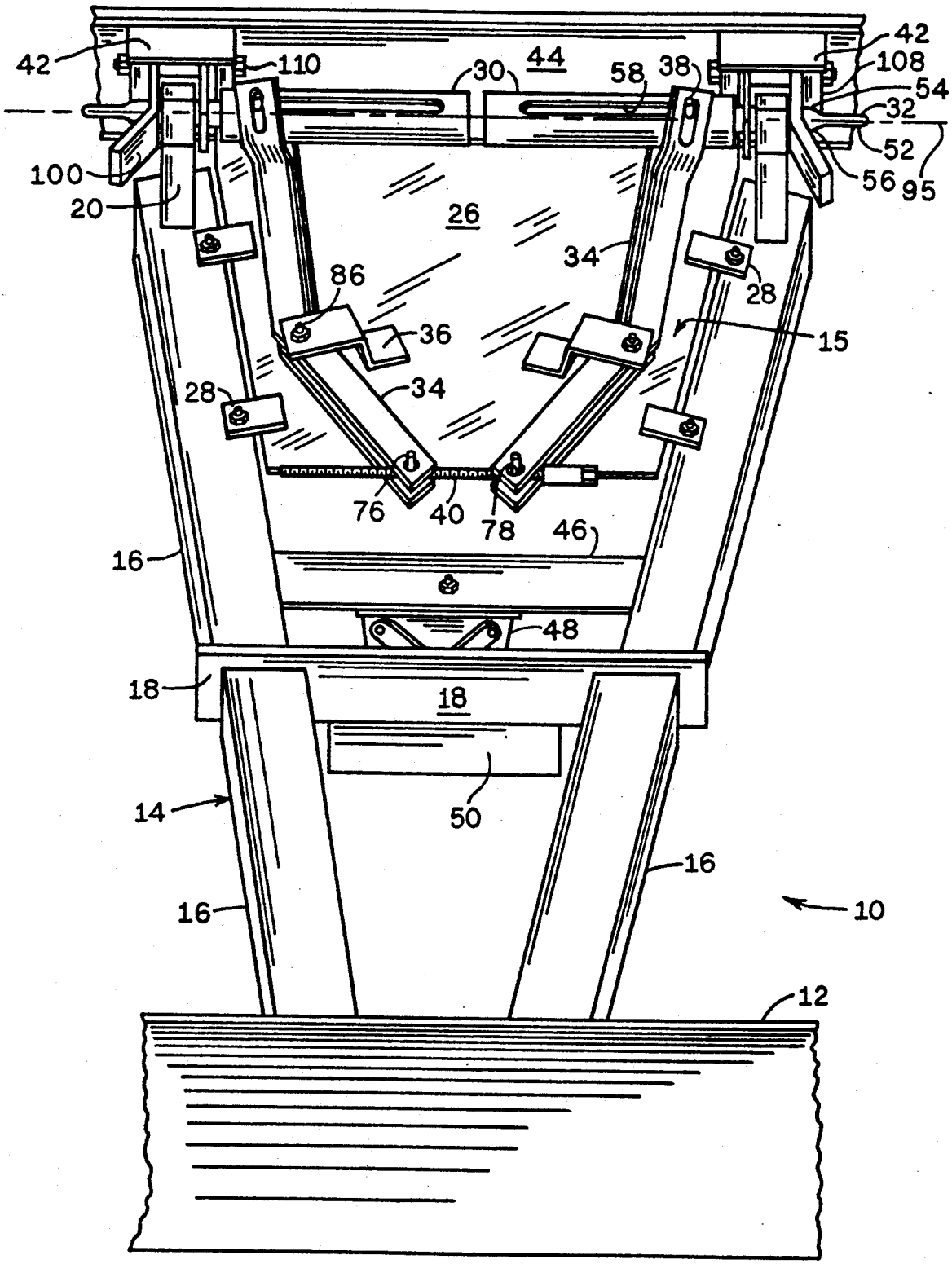
FIG. 1 shows a pictorial view of a plow of the invention, including attaching apparatus of the invention, attached to a frame member of a vehicle, with parts of the plow blade and the vehicle frame cut away.
Figure 2:
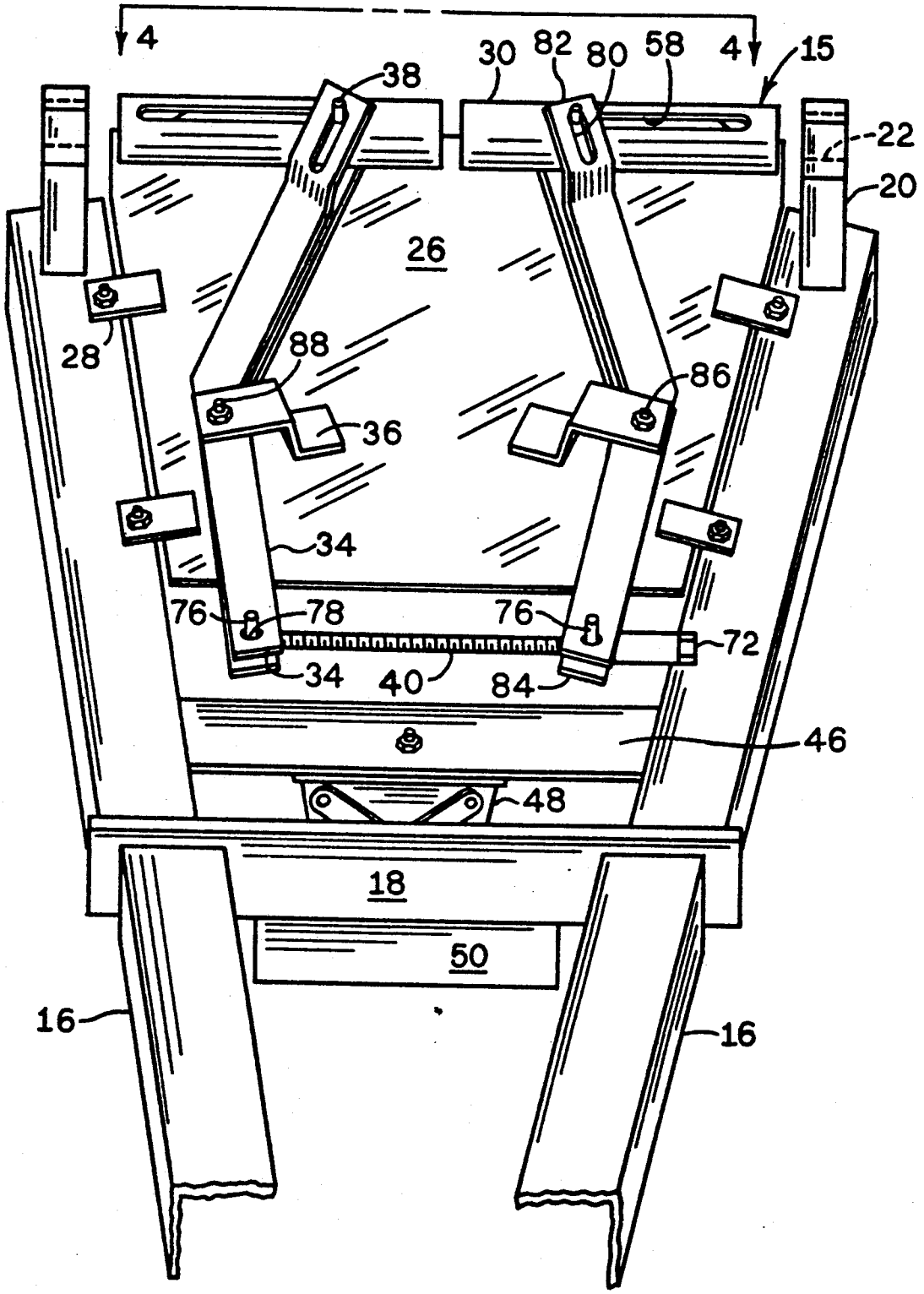
FIG. 2 is a pictorial view of the plow frame and including the attaching apparatus of the invention, with the pins retracted.

Referring to FIGS. 1 and 2, a plow 10 comprises generally a blade 12 which is the working member of the plow, a plow frame 14, and attaching apparatus generally depicted as 15.

The plow frame 14 includes right and left frame arms 16 having an intermediate header 18, and mounting ears 20. The mounting ears 20 include mounting holes 22 illustrated in FIG. 2.

Attaching apparatus 15 comprises generally a base plate 26, mounting tabs 28, pin barrels 30, attaching pins 32, right and left operated arms 34, angle braces 36 rigidly mounted to plate 26, roll pins 38, and operating screws 40; all of which are combined with the base plate 26. In addition, the attaching apparatus preferably includes adapter bracket 42 for mounting the plow frame to truck frame beam 44. The attaching apparatus also includes a cross jack plate 46 between frame arms 16, a jack 48, and a jack protecting plate 50, mounted to intermediate header 18 and positioned between jack 48 and plow blade 12.

Each attaching pin 32 includes an alignment portion 52 having a lesser constant cross-section, an engagement portion 54 having a greater cross-section, and a beveled intermediate transition portion 56 between alignment portion 52 and engagement portion 54. The pins 32 slide freely in pin barrels 30 and engage the operating arms 34 by means of roll pins 38 which extend through holes in the pins 32 and slots 58 in the barrels 30.

Pins 32 are extended from barrels 30 as seen in FIG. 1, and retracted into barrels 30 as seen in FIG. 2, by the operation of operating arms 34 as controlled by the operating screw 40.

Figure 3:
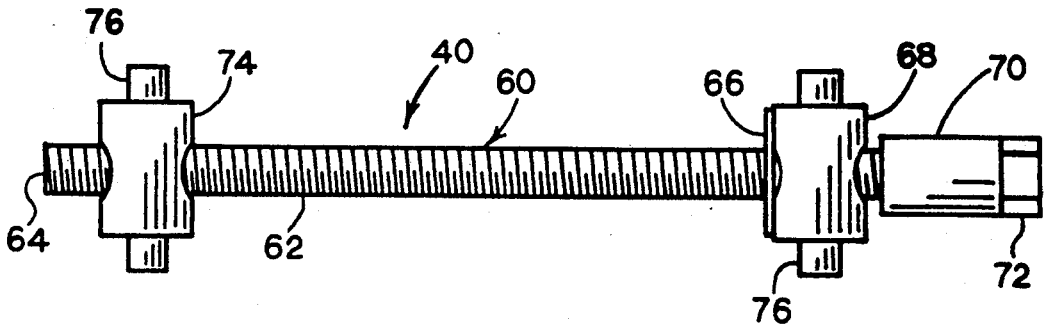
FIG. 3 shows a side view of the operating screw used with the attaching apparatus.

Referring now to FIG. 3, the operating screw has a shaft 60 including a threaded portion 62 which extends from its left end 64 to stop 66. Stop 66 is welded to the threaded portion. An unthreaded portion of the shaft 60 extends under trunnion 68 which is trapped between stop 66 and crank end 70. Crank end 70 ends with a conventional hexagonal head 72 as is conventionally used in nuts and bolts. Threaded trunnion 74 rides on the threaded portion 62 of the shaft 60. Studs 76 on trunnions 68 and 74 engage holes 78 in the operating arms 34. Shaft 60 thus extends from left end 64 to hexagonal head 72, whereby engagement and turning of hexagonal head 72, as by a wrench, causes the turning of the operating screw along its entire length.

Referring now to FIGS. 1 and 2, and noting the engagement of studs 76 with the operating arms 34, it is seen that trunnions 68 and 74 are prevented, by holes 78, from turning with the screw. The unthreaded portion of shaft 60 turns freely inside trunnion 68, without any movement of trunnion 68 along the shaft. Threaded trunnion 74, however, moves along threaded portion 62 as the shaft is turned. Thus, where shaft portion 62 has a right hand thread, a clockwise turning of operating screw 40 by means of turning on head 72 causes a movement of trunnion 74 toward head 72. A counterclockwise turning of hexagonal head 72, and accordingly shaft 60, causes trunnion 74 to move away from hexagonal head 72.

FIG. 2 shows the attaching apparatus of the invention with the attaching pins retracted into barrels 30, with roll pins 38 essentially advanced toward each other to the limit of slot 58. At this position, the slots 58 function as operating stops for roll pins 38, and, accordingly, for the operating arms and attaching pins 32. Thus the roll pins 38 provide a limit to the inward movement of the attaching pins 32. Accordingly, operating screw 40 is prevented from further turning in a counterclockwise direction once roll pins 38 have engaged the ends of slots 58 as illustrated in FIG. 2.

It is seen that roll pins 38 serve as a connecting means between pins 32 and slots 80 on the first ends 82 of operating arms 34. The second ends 84 of the operating arms 34 are engaged with studs 76 as described herein above. The operating arms 34 are loosely mounted to base plate 26 and angle braces 36 by means of mounting bolts 86 and associated locking nuts 88. With the operating arms 34 loosely mounted to base plate 26, they can readily pivot about the generally vertical axis of the mounting bolts 86.

Figure 4:
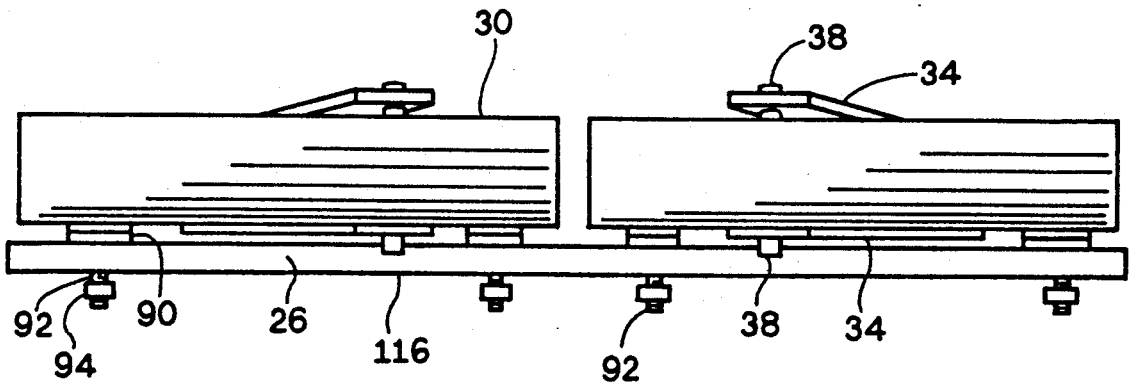
FIG. 4 shows a side view of the mounting of the barrels to the base plate and is taken at 4—4 of FIG. 2.

Referring now to FIG. 2, the turning of operating screw 40 in a clockwise manner by means of engaging a wrench on hexagonal head 72 results in trunnion 74 being advanced toward trunnion 68, whereby the second ends 84 of operating arms 34 are drawn closer to each other. Accordingly, as the operating arms pivot about mounting bolts 86, the first ends 82 of the operating arms move farther away from each other. The engagement of slots 80 and the roll pins 38 causes the attaching pins 32 to be correspondingly extended from barrels 30. Continuing to turn operating screw 40 causes a continuing advance of the second ends of the operating arms toward each other and a corresponding continuing advance of the first ends of the operating arms away from each other; with the associated advancement of pins 32 out of barrels 30. The limit of the movement of operating arms 34 in accordance with the turning of operating arm 40 is reached when the roll pins 38 engage the outermost ends of slots 58 as seen in FIG. 1. As pins 32 advance outwardly of the barrels 30 according to the above description, they pass through the plow frame mounting holes 22 in mounting ears 20. Pins 32 are aligned with mounting ears 20 at the time that the base plate 26, which has attached to it barrels 30 and operating arms 34, is mounted to the plow frame 14 by means of mounting tabs 28. The horizontal alignment of pins 32 with ears 20 and holes 22 is accomplished by the proper positioning of tabs 28 along frame arms 16. Vertical alignment of the pins with holes 22 is accomplished by means of shims 90, which are emplaced between barrels 30 and base plate 26. Shims 90, seen in FIG. 4, can also be emplaced between tabs 28 and frame arms 16 to achieve the same functional purpose. Since pins 32 are aligned with holes 22, and holes 22 are conventionally aligned with each other on a conventional plow, pins 32 are generally aligned with each other, allowing for the loose mounting of barrels 30 to base plate 26 using mounting screws 92 and locking nuts 94, as seen in FIG. 4. The alignment of pins 32, barrels 30, and holes 22 is generally indicated by a longitudinal alignment axis 95, whereby pins 32 are extended away from each other, and retracted toward each other, along axis 95.

Figure 5:
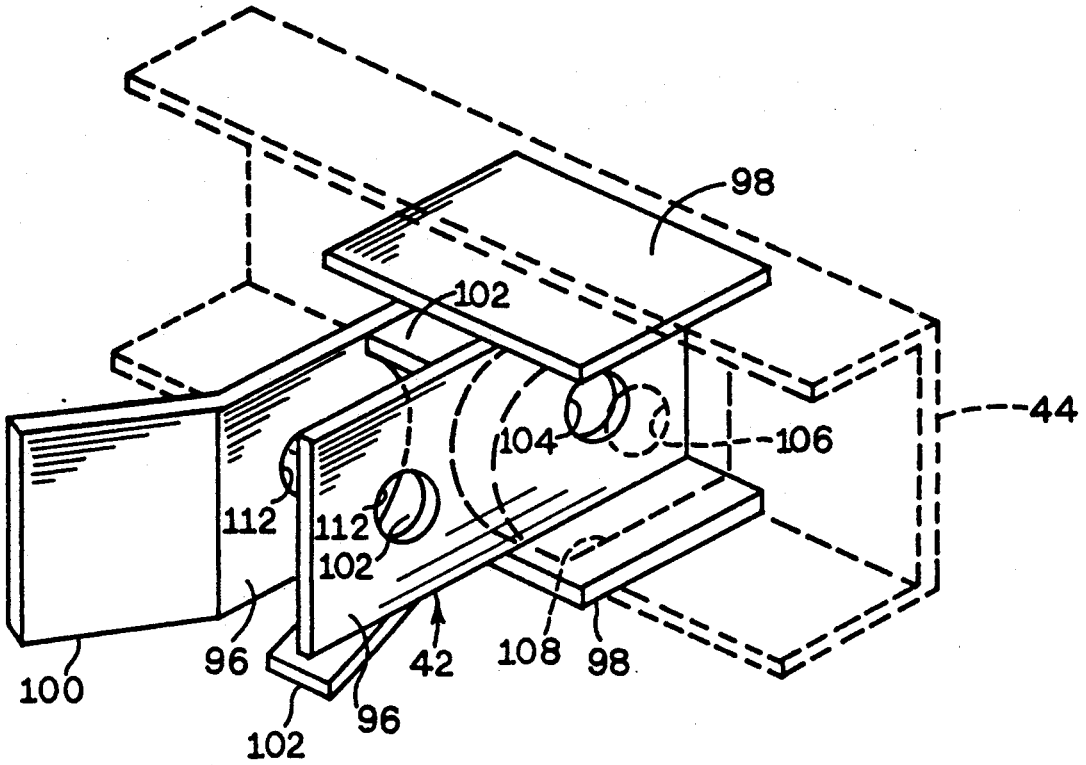
FIG. 5 shows a pictorial view of an adapter bracket.
Figure 6:
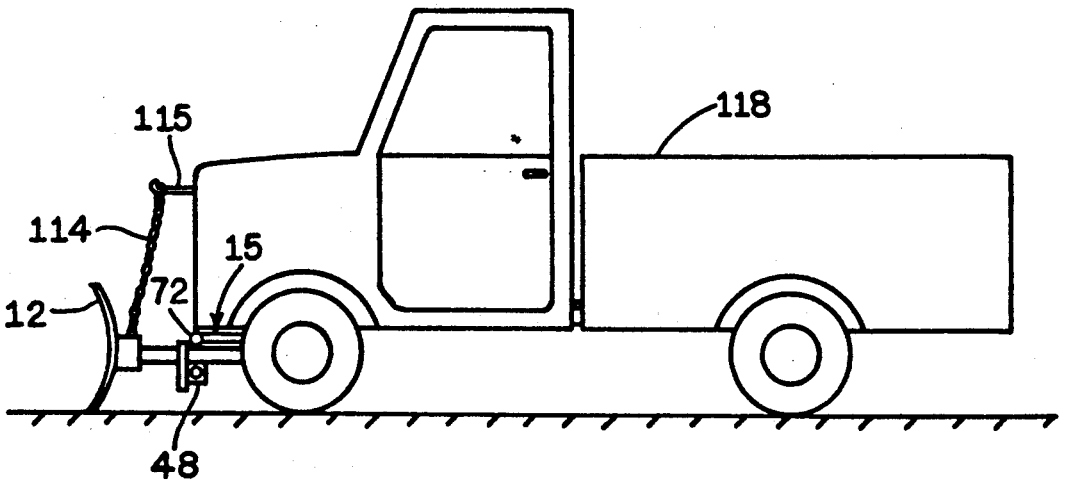
FIG. 6 shows a side view of a truck of this invention using the plow and attaching apparatus as disclosed herein.

As seen in FIG. 1, adapter brackets 42 preferably serves as an interface between the conventional truck frame beam 44 and the conventional plow mounting ear 20, when using the attaching apparatus disclosed herein above which is mounted on base plate 26. Each adapter bracket 42, as seen in FIG. 5, includes a pair of side plates 96, a pair of top and bottom positioning plates 98, a flare guide 100, and a mounting ear stop 102. Mounting holes 104 in the side plates 96 of adapter brackets 42 align with corresponding mounting holes 106 in ears 108 which extends from truck frame beam 44. The adapter brackets 42 are rigidly mounted to truck frame beam 44 by conventional mounting bolts 110 as seen in FIG. 1. Top and bottom positioning plates 98 interface with corresponding top and bottom surfaces of the ears 108, in securely positioning the adapter brackets with respect to the conventional frame ears 108. A second pair of holes 112 in side plates 96 are adapted for alignment with pins 32 for mounting the plow.

Jack 48 is illustrated as a conventional scissors jack. Other conventional jack designs are contemplated. The jack has a top mounting plate and a bottom base plate. The top mounting plate of the plow interfaces with, and is mounted to, cross jack plate 46 on the plow frame. The base plate, not shown, interfaces with the ground or other support. Scissors jack 48 is extended and retracted by means of an operating screw which operates in the same manner as described for operating screw 40. Accordingly, the operating screw of jack 48 is fitted with a hexagonal head of the same size as hexagonal head 72, whereby the same tool may be used for operating screw 40 and the jack 48.

In preparation for use of the apparatus of the invention as illustrated in FIG. 1, the adapter brackets 42 are bolted to the truck frame in the position shown in FIGS. 1 and 5. This is accomplished by positioning side plates 96 inwardly of the two truck mounting ears 108, with the top and bottom mounting plates 98 interfacing with the corresponding tops and bottoms of the truck frame ears 108. Bolts are then inserted and the nuts tightened in place. FIG. 1 illustrates that flare guides 100 extend away from each other. With adapter brackets 42 mounted to truck frame beam 44, which is a conventional beam to which plows are adapted for mounting on a pickup truck, the plows of the invention can then be quickly attached to the truck, and correspondingly detached.

Plow frame 14, and especially mounted ears 20 can be raised and lowered by raising and lowering jack 48, while plow blade 12 remains on the ground. Using jack 48, the mounting ears 20 are positioned at the approximate height of mounting holes 112. The truck is then driven up to the plow until the plow mounting ears engage the stops 102 on adapter brackers 42. Minor horizontal misalignment of the truck with the plow is corrected as flare guides 100 make minor positioning adjustments of thhe plow as it is entering adapter brackets 42. As indicated earlier, pins 32 are aligned with holes 22 in the plow mounting ears at the time that the pins are mounted to the plow by means of barrels 30 and base plate 26. The only remaining alignment is the alignment of holes 22 in the plow frame with holes 112 in the adapter brackets. Stops 102 in adapter brackets 42 prevent holes 22 from progressing significantly beyond holes 112. As long as the holes are partially aligned, the attachment can be made without further ado. Critical misalignment is readily corrected by making minor vertical adjustments with jack 48, whereby mounting ears 20 may be readily raised or lowered.

As soon as partial alignment of holes 22 and holes 112 is achieved, and wherein the operating screw 40 and the pins 32 are in the positions shown in FIG. 2, operating screw 40 is turned clockwise. For efficient operation, a speed ratchet from a socket wrench set is preferred. As the operating screw is turned clockwise, pins 32 begin to extend from the barrels 30. Since the alignment portions 52 of pins 32 are substantially smaller in cross-section than the holes 112 in adapter bracker 42, the alignment portion 52 of the pins will extend into holes 112 even if there is a partial misalignment of holes 112, with the pins and holes 22. As the attaching pins progress into holes 112, the intermediate transition portions 56 of the attaching pins begin to engage the edges of holes 112 and encourage completion of the alignment of the respective holes. Minor misalignments will automatically be corrected by the beveled intermediate transition portions 56 and the turning of the screw can proceed until the pins are fully extended as seen in FIG. 1. Once the pins are fully extended whereby roll pins 38 are engaging the ends of slots 58, operating screw 40 is turned counterclockwise one or two rotations for purposes which will be explained further hereinafter.

If significant resistance is encountered as the intermediate transition portions 56 of the pins engage the edges of holes 112, the turning of the operating screw is temporarily halted, and the lifting chain 114 is attached to the lift arm 115 on the truck. The plow blade 12 is then lifted slightly off the ground and the entire plow frame is vigorously shaken. While shaking the plow and cranking the operating screw 40 at the same time, the bevel on the intermediate transition portion between the alignment portion and the engagement portion assist in aligning the holes such that the pins can go all the way in place, with corresponding full engagement between the engagement portions 54 of the pins and holes 22 and 112. The full engagement position is seen in FIG. 1. A bevel, not shown, on the edge of the corresponding hole 112 which first encounters the attaching pin, facilitates the above mounting process.

Once the pins are fully engaged, the jack 48 is retracted, and especially is retracted behind the protecting plate 50. The purpose of protecting plate 50 is to protect jack 48.

When it is desired to detach the plow from the truck, the blade is lowered and the lift chain 114 removed. The jack 48 is then extended until the base plate engages the ground and resistance is felt. This indicates that the jack has taken at least part of the weight of the plow frame, which loosens pins 32. The operating screw is then engaged with the speed ratchet and turned counterclockwise, whereby the pins are retracted to the position shown in FIG. 2. Once the pins are fully retracted into barrels 30, the truck can be backed away from the plow. Jack 48 remains extended and holds the plow in the proper elevation for being reattached to the truck. To reattach the plow to the truck, the truck is driven up to the plow. Any minor horizontal misalignment of plow mounting ears 20 with adapter brackets 42 is corrected by automatic positioning of the plow ears as they engage the flare guides 100. As stops 102 on adapter bracket 42 engage mounting ears 20 on the plow, the truck is stopped. Any misalignment is corrected with the jack or by shaking the plow as indicated earlier and the pins are inserted according to the earlier description. The plow is thus reattached to the truck and, as soon as the lift chain is engaged, is ready for use.

A significant feature of the invention is that force transmitted from the vehicle 118 to the blade passes from the truck frame beam 44 through the pins 32 to the right and left frame arms 16 of the plow without passing through the balance of the attachment apparatus which is mounted to the base plate 26. This is accomplished by loosely mounting barrels 30 and operating arms 34 to the base plate. The loose mounting of the barrels to the base plate is illustrated in FIG. 4 wherein locking nuts 94 are not in engagement with the bottom 116 of base plate 26. Rather FIG. 4 illustrates that the locking nuts are spaced from the bottom 116 of the base plate. Thus the barrel 30 can move relative to the rigidly mounted base plate 26 without transmitting any significant force from the barrels to the base plate. Similarly, bolt 86 and locking nuts 88 loosely mount the operating arms 34 to angle braces 36 and base plate 26. Accordingly, operating arms 34 also avoid transmitting any force by means of their loose mounting. Angle braces 36, however, are rigidly mounted to base plate 26 as by welding. Mounting tabs 28 are also rigidly mounted to base plate 26 as by welding or by bolts.

In order for the transmission of the force of the truck to assuredly bypass barrels 30 and operating arms 34, it is only necessary that the tolerance between pins 32 and the edges of holes 22 and 112 be less than the distance which barrels 30 and operating arms 34 can move freely, whereby barrels 30 and operating arms 34 necessarily can move to a null position wherein the force is not transmitted through the barrels and operating arms. Thus, the relatively loose mounting of the pin-carrying barrels 30 to base plate 26 permits force transmitted from vehicle brackets 42 to be applied to pins 30 which in turn bear directly against plow frame brackets 20, and thus any pushing or shifting motion imparted to the pins 30 as vehicle movement takes up any slack in the pin- and bracket connections will not be imparted to the barrels 30 carrying the pins, or to the operating arms 34 as both the barrels and arms can loosely shift on their respective mounts 92, 94 and 86, 88 to permit the pins to receive and transmit all force directly to frame brackets 20.

After pins 32 have been extended fully to where roll pins 38 engage the ends of slots 58, it is preferred to retract them slightly by turning operating screw 40 counterclockwise one or two turns. Accordingly, the roll pins 38 are disengaged from the ends of slots 58 whereby the pins 38 are assured to have some clearance from the ends of slots 58. This further enhances the loose assemblage of the attaching apparatus on base plate 26.

It will be appreciated that jack 48 can be mounted in other locations on the plow frame. It is seen mounted on cross jack plate 46. It could also be mounted on base plate 26. Whenever the mounting of the jack is referred to herein with respect to the jack being mounted to a base, all such mounting locations are contemplated and especially the base plate 26 and the cross jack plate 46. As seen from a comparison of FIGS. 1 and 2, which illustrate the extremes of operative movement of arms 34, it is only necessary that the mounting locus (e.g. screws 86 or single replacement thereof) be spaced from axis 95 a sufficient distance to facilitate pivotation of arms 34 about the mounting locus, as well as the sliding of roll pins 38 in slot 80.

Applicant considers that it would be possible to replace mounting screws 86 with a single, central mounting screw disposed intermediate the two locations shown in FIGS. 1 and 2, with the operating arms 34 both mounted to the base plate by means of this single mounting bolt. Thus, wherever in this description and in the following claims, operating arms 34 are described as being mounted to the base or base plate by first and second mounting means, it is contemplated that a single mounting means is the functional equivalent and the same is comprehended and intended thereby. Similarly, operating arms 34 could be mounted to the left and right frame arms 16 rather than to base plate 26. Same is also contemplated and comprehended within the intention of both the teaching and claims herein.

Truck frame ears 108 may also be considered plow mounting brackets of a vehicle 118 and same is contemplated herein.

Truck frame beam 44 is considered a vehicle structural member adapted for mounting a snow plow means of the frame ears 108.

Pins 32 are loosely attached to base plate 26 through barrels 30 and to operating arms 34 through roll pins 38. Operating arm 34, as described earlier, are loosely attached to base plate 26 through brackets 36 and bolts 86. Thus force transmitted from the vehicle to the blade passes from the vehicle's structural member 44 through the pins to the plow frame 14, without passing through the balance of the attachment apparatus, and especially through barrels 30 and operating arms 34.

The loose mounting of barrels 30 and operating arms 34 by means of the corresponding locking nuts, and the leaving of some spacing between the bottom of base plate 26 and the corresponding nuts or bolts, is considered a secure attachment by virtue of the use of the locking nuts.

Operating screw 40 comprises means for sequentially moving the first ends 82 of the operating arms away from each other and toward each other.

Screw 40 is preferably attached only to operating arms 34, and is not otherwise anchored to either the plow frame or base plate 26. Accordingly, as the screw is turned and the operating arms are moved closer together, or farther apart, each arm 34 can pivot about its respective mounting bolts 86 independently without regard to any pivoting of the other arm 34 about the corresponding other mounting bolt 86. The actual movement depends on the relative ease of movement of the arms. For example, if the left operating arm 34 can move more easily than the right operating arm, then the left arm only can move until it encounters some resistance at least equal to resistance being experienced by the right operating arm. Then both arms can move simultaneously. Or the right arm may move alone. This process is continued until both arms have extended their pins into full engagement as seen in FIG.1.

Wherever herein the operating arms are described as being engaged with the attaching pins 32 it is understood that the means of the engagement is roll pins 38.

Those skilled in the art will now see that certain modifications can be made to the apparatus and methods disclosed herein with respect to the preferred embodiments without departing from the spirit of the instant invention. And while the invention has been described above with respect to its preferred embodiments it will be understood that the invention is capable of numerous rearrangements, modifications, and alterations, and all such arrangements, modifications, and alterations are intended to be within the scope of the appended claims.

Having thus described the invention, what is claimed is:

1. Plow attaching apparatus, comprising:

(a) a base;

(b) first and second operating arms each having first and second ends;

(c) first and second pins mounted for axial movement to be extendable away from each other and to retract toward each other;

(d) connecting means connecting said operating arms to said pins;

(e) mounting means mounting said operating arms to said base for pivotal movement about said mounting means; and (f) moving means connected to said operating arms, and adapted to move said ends of said operating arms (i) toward each other and (ii) away from each other thereby to extend and retract said pins through said connecting means, said connecting means including means between said pins and said arms for permitting sliding motion between said pins and said arms during movement of said arms.

2. Plow attaching apparatus as in claim 1, each said pin comprising a constant cross-section alignment end portion having a lesser constant cross-section, an engagement portion having a greater cross-section, and an intermediate transition portion between said alignment and engagement portions, said engagement portion being disposed between said transition portion and a said end of the corresponding one of said operating arms.

3. Plow attaching apparatus, comprising:

(a) a base;

(b) first and second operating arms each having first and second ends;

(c) first and second pins, adapted to extend away from each other and to retract toward each other;

(d) mounting means mounting said operating arms to said base, and for pivotal movement about said mounting means, said first and second pins being connected to corresponding ones of said operating arms at locations removed from said mounting means; and (e) moving means connected to said operating arms, and adapted to move said second ends of said operating arms (i) toward each other and (ii) away from each other, wherein the combination of said mounting of said operating arms and said connection of said moving means to said operating arms is adapted to pivot one said operating arm with respect to said mounting means independent of pivotation of the other said operating arm.

4. Plow attaching apparatus as in claim 3, each said pin comprising a constant cross-section alignment end portion having a lesser constant cross-section, an engagement portion having a greater cross-section, and an intermediate transition portion between said alignment and engagement portion, said engagement portion being disposed between said transition portion and said first end of the corresponding one of said operating arms.

5. Plow attaching apparatus, comprising:

(a) a base;

(b) first and second operating arms each having first and second ends;

(c) first and second pins, having connections to corresponding ones of said operating arms, said pins being adapted to extend away from each other and to retract toward each other;

(d) mounting means mounting said operating arms to said base, and for pivotal movement about said mounting means, said connection connecting said first and second pins to corresponding ones of said first and second operating arms being disposed at locations removed from said mounting means; and (e) moving means connected only to said operating arms, and adapted to move said second ends of said operating arms (i) toward each other and (ii) away from each other.

6. Plow attaching apparatus as in claim 5, each said pin comprising a constant cross-section alignment end portion having a lesser constant cross-section, and engagement portion having a greater cross-section, and an intermediate transition portion between said alignment and engagement portions, said engagement portion being disposed between said transition portion and said first end of the corresponding one of said operating arms.

7. Plow attaching apparatus for attaching a plow to a vehicle, comprising:

(a) a base;

(b) first and second pin holding means;

(c) first and second mounting means mounting said first and second pin holding means to said base, and said mounting means accommodating movement of said pin holding means relative to said base;

(d) first and second pins slidably received in corresponding ones of said first and second pin holding means;

(e) first and second operating arms connected to corresponding ones of said first and second pins;

(f) third and fourth mounting means pivotally mounting said first and second operating arms to said base, and said third and fourth mounting means accommodating movement of said operating arms relative to said base; and (g) moving means connected to said operating arms, and adapted to move said second ends of said operating arms (i) toward each other and (ii) away from each other, said accommodation of movement in said mounting means being effective to accommodate sufficient movement of said operating arms and said pin holding means, relative to said base, so that when force is transmitted from the vehicle through said pins to the plow, said operating arms and said pin holding means can shift to take positions wherein the force is not transmitted through said operating arms and said pin holding means.

8. Plow attaching apparatus as in claim 7, each said pin comprising a constant cross-section alignment end portion having a lesser constant cross-section, an engagment portion having a greater cross-section, and an intermediate transition portion between said alignment and engagement portions, said engagement portion being disposed between said transition portion and said first end of the corresponding one of said operating arms.

9. An apparatus as in claim 7, wherein the combination of said operating arms and said moving means, on said attaching apparatus is adapted to pivot one said operating arm with respect to said mounting means independent of pivotation of the other said operating arm.

10. An implement as in claim 7 wherein moving means, on said attaching apparatus is connected only to said operating arms.

11. The apparatus of claim 7 wherein said snow plow includes a plow blade.

12. An implement as in claim 11 wherein the combination of said operating arms and said moving means, on said attaching apparatus, is adapted to pivot one said operating arm with respect to said mounting means independent of pivotal movement of the other said operating arm.

13. An implement as in claim 11 wherein said moving means, on said attaching apparatus, is connected only to said operating arms.

* * * * *